US007264374B1

(12) United States Patent
Spika

(10) Patent No.: US 7,264,374 B1
(45) Date of Patent: Sep. 4, 2007

(54) DECORATIVE LIGHTING ASSEMBLY

(76) Inventor: Kevin W. Spika, 11 Greenfield Dr., South Windsor, CT (US) 06074

( * ) Notice: Subject to any disclaimer, the term of this patent is extended or adjusted under 35 U.S.C. 154(b) by 0 days.

(21) Appl. No.: 11/371,955

(22) Filed: Mar. 10, 2006

(51) Int. Cl.
*F21V 21/00* (2006.01)

(52) U.S. Cl. ..... 362/249; 362/657; 362/219; 362/221; 362/225; 362/391; 362/224

(58) Field of Classification Search ..... 362/249, 362/219, 221–225, 649–654, 657–659, 391, 362/236–241; 315/155–156; 439/228, 235, 439/698, 320, 638–639
See application file for complete search history.

(56) References Cited

U.S. PATENT DOCUMENTS 2,335,041 A * 11/1943 Bruno ..... 174/87
4,271,458 A 6/1981 George, Jr.
5,118,301 A * 6/1992 Bentivolio ..... 439/188
5,372,525 A 12/1994 Wu et al.
5,967,823 A * 10/1999 Tsui ..... 439/280
6,039,458 A 3/2000 Coates, Jr. et al.
D424,720 S 5/2000 Nichols, Jr.
6,210,189 B1 * 4/2001 Gantt ..... 439/214
6,265,834 B1 7/2001 Lin
6,422,891 B1 * 7/2002 Huang ..... 439/367
6,793,369 B2 * 9/2004 Calzaretta et al. ..... 362/219
RE38,909 E * 12/2005 Rahman ..... 362/249
2004/0183458 A1 9/2004 Lee

* cited by examiner

*Primary Examiner*—Renee Luebke
*Assistant Examiner*—Robert May

(57) ABSTRACT

A decorative lighting assembly includes a plurality of light emitters each having a pair of oppositely positioned first male connectors. The light emitters emit light when power flows through the first male connectors of the light emitters. A plurality of elongated couplers is provided and each has a pair of first female connectors electrically coupled together and positioned opposite of each other. Each of the first female connectors is configured to receive and electrically connect to one of the first male connectors. The light emitters are each positioned between and electrically coupled to a pair of elongated couplers to form a strand of electrically coupled light emitters. The strand is electrically coupled to a power supply coupler configured for electrically engaging a female power outlet.

3 Claims, 4 Drawing Sheets

DECORATIVE LIGHTING ASSEMBLY

BACKGROUND OF THE INVENTION

1. Field of the Invention

The present invention relates to decorative lighting devices and more particularly pertains to a new decorative lighting device for forming strands of in-line light emitters that may be mounted around an object such as a window.

2. Description of the Prior Art

The use of decorative lighting devices is known in the prior art. While these devices fulfill their respective, particular objectives and requirements, the need remains for a device that includes in-line light emitters for the appearance of a cleaner look and to allow a person more control over the positioning of the light emitters. Further, the device should allow a person to selectively alter the length of a strand of the in-line light emitters.

SUMMARY OF THE INVENTION

The present invention meets the needs presented above by generally comprising a plurality of light emitters each having a pair of oppositely positioned first male connectors. The light emitters emit light when power flows through the first male connectors of the light emitters. A plurality of elongated couplers is provided and each has a pair of first female connectors electrically coupled together and positioned opposite of each other. Each of the first female connectors is configured to receive and electrically connect to one of the first male connectors. The light emitters are each positioned between and electrically coupled to a pair of elongated couplers to form a strand of electrically coupled light emitters. The strand is electrically coupled to a power supply coupler configured for electrically engaging a female power outlet.

The present invention meets the needs presented above by also generally comprising a plurality of light emitters. Each of the light emitters has a pair of oppositely positioned first male connectors. The light emitters emit light when power flows through the first male connectors of the light emitters. A plurality of elongated couplers is provided and each has a pair of first female connectors electrically coupled together and positioned opposite of each other. Each of the first female connectors is configured to receive and electrically connect to one of the first male connectors. The light emitters are positioned between and electrically coupled to a pair of elongated couplers to form a strand of electrically coupled light emitters. A plurality of power couplers each includes a first male connector and a second male connector electrically coupled together. Each of a plurality of loop couplers includes three second female connectors. Each of the second female connectors is configured to electrically couple with one of the second male connectors. Two of the second female connectors are directed opposite of each other and are each electrically coupled to a third of the second female connectors. Each of the second female connectors comprises a threaded aperture and each of the second male connectors comprises a threaded rod. A power supply coupler includes a second male connector and a male socket plug electrically coupled together. The second male connector of the power supply is electrically coupled to the third of the second female connectors.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
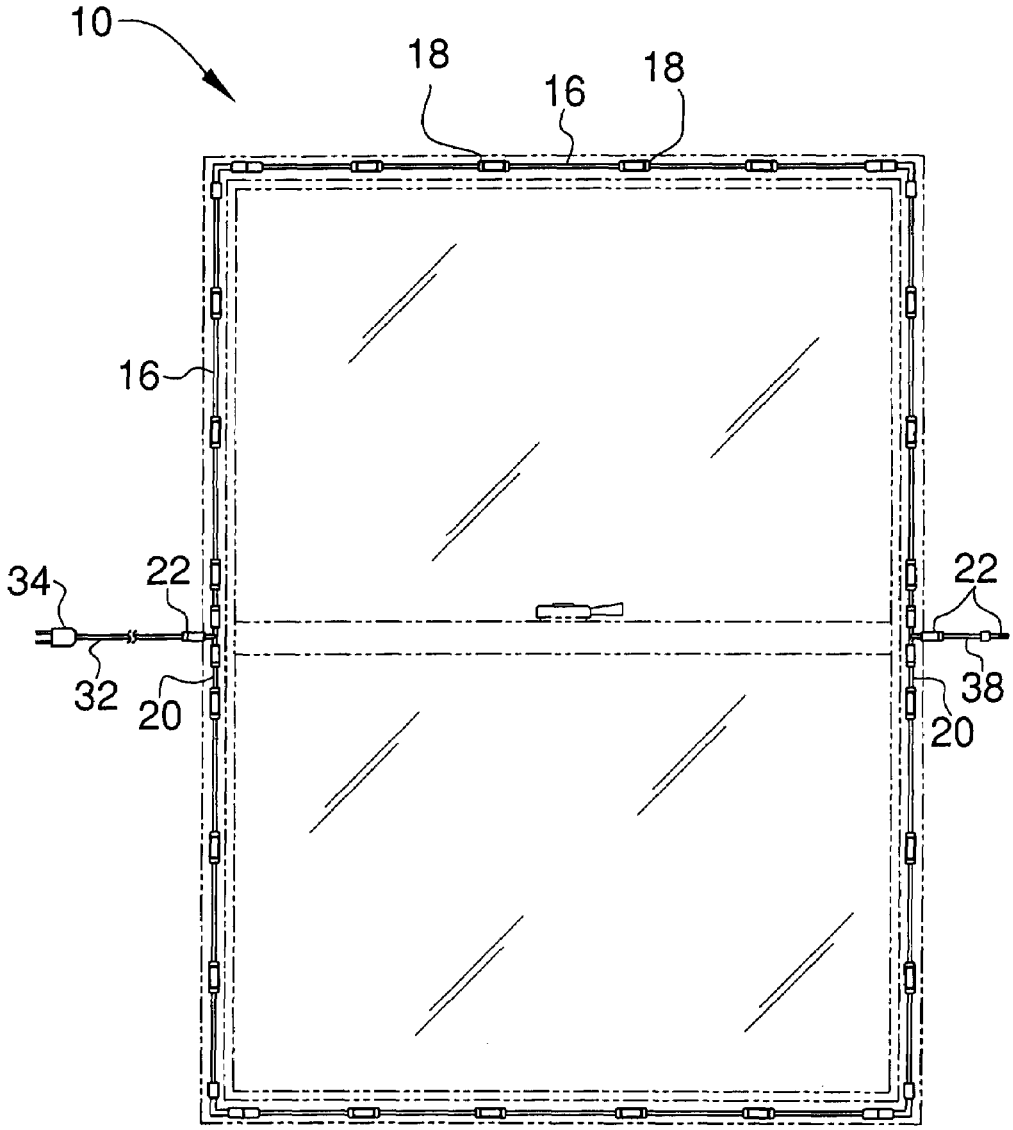
FIG. 1 is a front view of a decorative lighting assembly according to the present invention.
Figure 2:
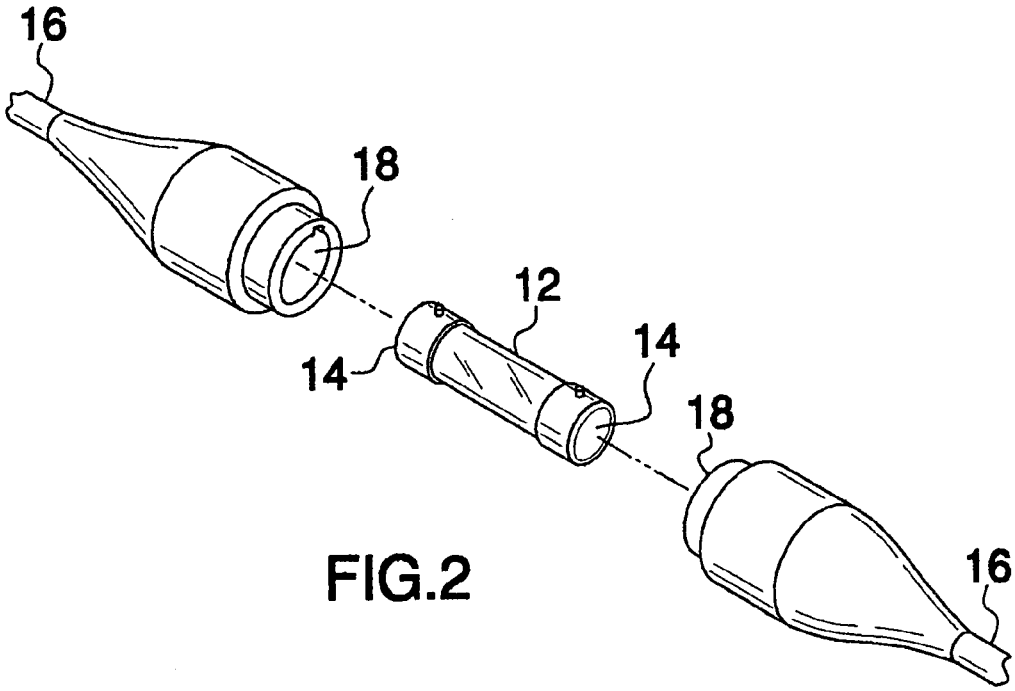
FIG. 2 is a perspective view of a light emitter of the present invention.
Figure 3:
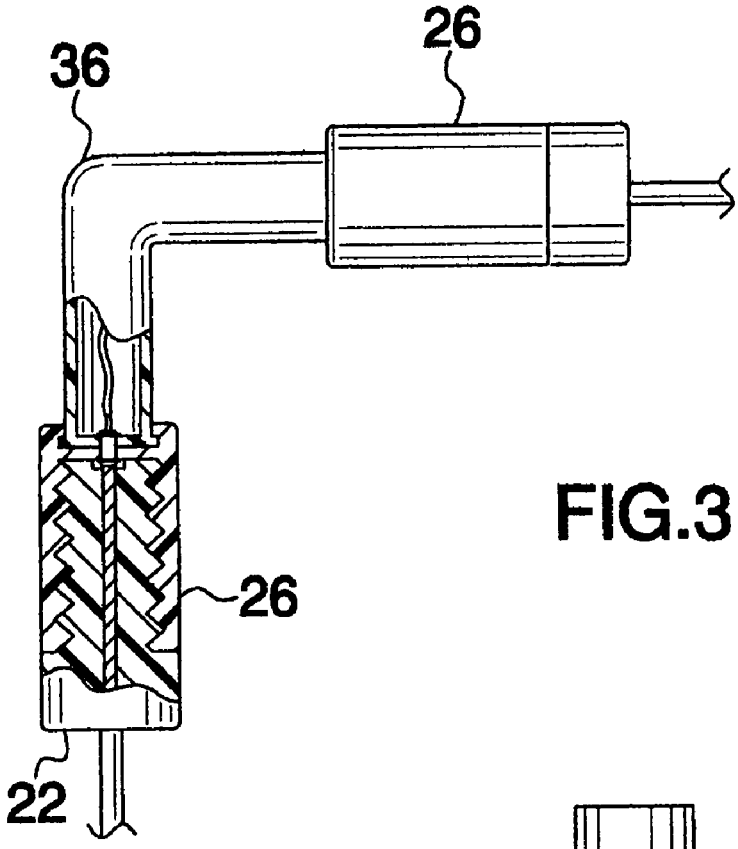
FIG. 3 is a front view of a corner coupler of the present invention.
Figure 4:
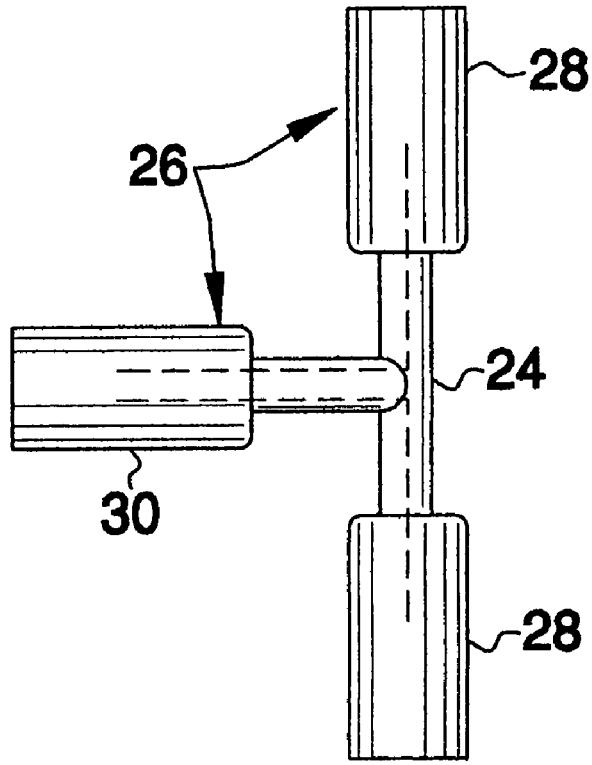
FIG. 4 is a front view of a loop coupler of the present invention.
Figure 5:
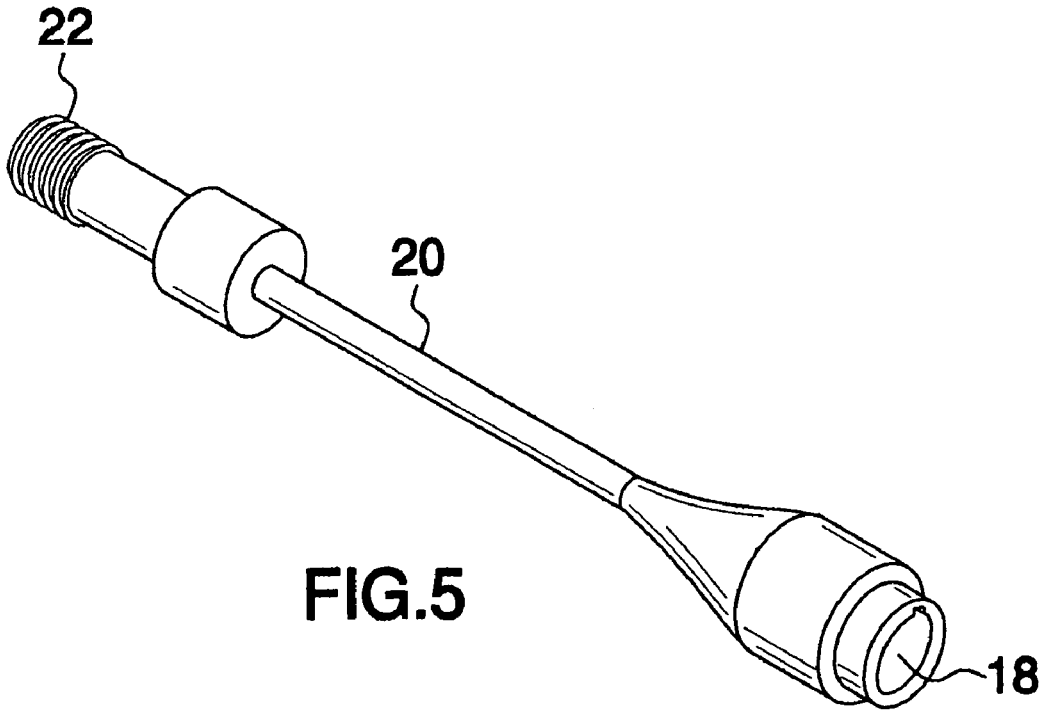
FIG. 5 is a perspective view of a power coupler of the present invention.

With reference now to the drawings, and in particular to FIGS. 1 through 5 thereof, a new decorative lighting device embodying the principles and concepts of the present invention and generally designated by the reference numeral 10 will be described.

As best illustrated in FIGS. 1 through 5, the decorative lighting assembly 10 generally comprises a plurality of light emitters 12. Each of the light emitters 12 has a pair of oppositely positioned first male connectors 14. The light emitters 12 emit light when power flows through the first male connectors 14 of the light emitters 12.

A plurality of elongated couplers 16 is provided. Each of the elongated couplers 16 has a pair of first female connectors 18 electrically coupled together and positioned opposite of each other. Each of the first female connectors 18 is configured to receive and electrically connect to one of the first male connectors 14. Each of the light emitters 12 is positioned between and electrically coupled to a pair of elongated couplers 16 to form a strand of electrically coupled light emitters 12.

Each of a plurality of power couplers 20 includes a first female connector 18 and a second mate connector 22 electrically coupled together. A plurality of loop couplers 24 is provided. Each of the loop couplers includes 24 three second female connectors 26. Each of the second female connectors 26 is configured to electrically couple with one of the second male connectors 22. Two of the second female connectors 28 are directed opposite of each other and are each electrically coupled to a third 30 of the second female connectors 26. Each of the second female connectors 26 comprises a threaded aperture. Each of the second male connectors 22 comprises a threaded rod.

A power supply coupler 32 includes a second male connector 22 and a male socket plug 34 electrically coupled together. The second male connector 22 of the power supply coupler 32 is electrically coupled to the third 30 of the second female connectors 26. The male socket plug 34 may be extended into a female power outlet.

A plurality of corner couplers 36 is provided. Each of the corner couplers 36 has a pair of ends comprising a second female connector 26 configured to receive one of the second male connectors 22. Each of the corner couplers 36 has associated ones of the second female connectors 26 orientated perpendicular to each other in a substantially rigid configuration.

Each of a plurality of extension couplers 38 has a pair of ends comprising a second male connector 22 configured to electrically couple with one of the third 30 of the second female connectors 26. Each of the extension couplers 38 has associated ones of the second male connectors 22 is selectively orientated with respect to each other.

In use, the corner couplers 36, elongated couplers 16, power couplers 32 and loop couplers 24 are connected in a manner desired by a user of the assembly to form a loop of light emitters 12 that may be positioned around an object. By keeping the light emitter 12 in line with the elongated couplers 16, the assembly 10 provides cleaner look. The extension couplers 38 allow users of the assemblies to selectively couple together a plurality of loops or light emitters 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative light assembly comprising:

a plurality of first male connectors, a plurality of second male connectors, a plurality of first female connectors, a plurality of second female connectors, each of said first male connectors being removably mated with one of said first female connectors, each of said second male connectors being removably mated with one of said second female connectors;

a plurality of light emitters, each of said light emitters being elongated and having a pair of ends each having one of said first male connectors attached thereto and electrically coupled to an associated one of said light emitters, associated ones of said first male connectors being positioned opposite of each other, said light emitters emitting light when power flows through said first male connectors of said light emitters; and a plurality of elongated couplers, each of said elongated couplers including a pair of said first female connectors electrically coupled together and positioned opposite of each other, each of said first female connectors being configured to receive and electrically connect to one of said first male connectors, a plurality of said light emitters being positioned between and electrically coupled to a pair of elongated couplers to form a strand of electrically coupled light emitters, said strand being electrically coupled to a power supply coupler configured to electrically engage a female outlet;

a plurality of power couplers, each of said power couplers including one of said first female connectors and one of said second male connectors electrically coupled together, at least two of said light emitters being electrically coupled to said elongated couplers and being simultaneously electrically coupled to said first female connectors of two of said power couplers and to said first female connectors of said elongated couplers, said strand terminated with two of said power couplers; and a plurality of loop couplers, each of said loop couplers including three of said second female connectors, each of said second female connectors being configured to electrically couple with one of said second male connectors, wherein two of said second female connectors of said loop couplers are directed opposite of each other and are each electrically coupled to a third one of said second female connectors of said loop couplers, at least two of said second male couplers of said power couplers attached to said strand being joined together with at least one of said loop couplers to form a closed loop of electrically coupled light emitters.

2. The assembly according to claim 1, further including:

a plurality of corner couplers, each of said corner couplers having a pair of ends each comprising one of said second female connectors, each of said corner couplers having associated ones of said second female connectors orientated perpendicular to each other in a substantially rigid configuration, said power couplers being coupled to one of said second female connectors of said corner couplers and to one of said first male connecters of said light emitters.

3. The assembly according to claim 1, further including a plurality of extension couplers, each of said extension couplers having a pair of ends each comprising one of said second male connectors, each of said extension couplers having associated ones of said second male connectors being selectively orientated with respect to each other.

* * * * *